US007744525B2

(12) United States Patent
Hochmair et al.

(10) Patent No.: US 7,744,525 B2
(45) Date of Patent: Jun. 29, 2010

(54) MOVING COIL ACTUATOR FOR MIDDLE EAR IMPLANTS

(75) Inventors: Ingeborg Hochmair, Axams (AT); Erwin S. Hochmair, Axams (AT)

(73) Assignee: MED-EL Elektromedizinische Geraete GmbH, Innsbruck (AT)

( * ) Notice: Subject to any disclaimer, the term of this patent is extended or adjusted under 35 U.S.C. 154(b) by 363 days.

(21) Appl. No.: 11/782,123

(22) Filed: Jul. 24, 2007

(65) Prior Publication Data

US 2008/0021518 A1 Jan. 24, 2008

Related U.S. Application Data

(60) Provisional application No. 60/832,821, filed on Jul. 24, 2006.

(51) Int. Cl.
*H04R 25/00* (2006.01)

(52) U.S. Cl. ..... 600/25; 607/57

(58) Field of Classification Search ..... 607/55–57, 607/137, 60; 623/10, 420.6; 600/15, 25; 381/312

See application file for complete search history.

(56) References Cited

U.S. PATENT DOCUMENTS

| | | | | |
|---|---|---|---|---|
| 5,163,957 | A * | 11/1992 | Sade et al. | 623/10 |
| 5,220,918 | A | 6/1993 | Heide et al. | 128/420.6 |
| 5,456,654 | A | 10/1995 | Ball | 600/25 |
| 5,554,096 | A | 9/1996 | Ball | 600/25 |
| 5,624,376 | A | 4/1997 | Ball et al. | 600/25 |
| 5,800,336 | A | 9/1998 | Ball et al. | 600/25 |
| 6,084,975 | A | 7/2000 | Perkins | 381/326 |
| 6,141,591 | A * | 10/2000 | Lenarz et al. | 607/57 |
| 6,161,046 | A * | 12/2000 | Maniglia et al. | 607/57 |
| 6,190,305 | B1 | 2/2001 | Ball et al. | 600/25 |
| 6,217,508 | B1 | 4/2001 | Ball et al. | 600/25 |
| 6,436,028 | B1 * | 8/2002 | Dormer | 600/25 |
| 2001/0016678 | A1 * | 8/2001 | Kennedy | 600/25 |
| 2003/0036675 | A1 | 2/2003 | Bachler et al. | 600/25 |
| 2004/0057588 | A1 | 3/2004 | Asnes | 381/151 |
| 2004/0133250 | A1 | 7/2004 | Ball et al. | 607/57 |
| 2005/0004629 | A1 * | 1/2005 | Gibson et al. | 607/60 |
| 2005/0020873 | A1 | 1/2005 | Berrang et al. | 600/25 |
| 2005/0077872 | A1 * | 4/2005 | Single | 320/114 |
| 2007/0191673 | A1 | 8/2007 | Ball et al. | 600/25 |

OTHER PUBLICATIONS

EPO—International Search Authority, International Search Report and Written Opinion, Dec. 27, 2007, PCT/US2007/074195.

* cited by examiner

*Primary Examiner*—Carl H Layno
*Assistant Examiner*—Paula J Stice
(74) *Attorney, Agent, or Firm*—Sunstein Kann Murphy & Timbers LLP

(57) ABSTRACT

A hearing enhancement includes an audio processor that generates an electrical audio signal and transmits the signal to a coil. The coil is implanted into a patient in a position that results in transmission of mechanical stimulation to the inner ear when the coil is spatially displaced. A permanent magnet is placed in proximity to the coil so that when the coil receives the electrical audio signal form the processor, the induced coil magnetic field in the coil interacts with the magnetic field from the permanent magnet to spatially displace the coil and, as a result, transmit the mechanical stimulation to the inner ear.

5 Claims, 3 Drawing Sheets

MOVING COIL ACTUATOR FOR MIDDLE EAR IMPLANTS

The present application claims priority from U.S. Provisional Patent Application 60/832,821, filed Jul. 24, 2006, the contents of which are incorporated herein by reference.

FIELD OF THE INVENTION

The present invention relates to improving hearing for the hearing-impaired.

BACKGROUND ART

FIG. 1 shows the anatomy of a normal human ear. A normal ear transmits sounds through the outer ear 101 to the eardrum 102, which moves the bones of the middle ear 103, which in turn excites the cochlea 104. The cochlea (or inner ear) 104 includes an upper channel known as the scala vestibuli 105 and a lower channel known as the scala tympani 106, which are connected by the cochlear duct 107. In response to received sounds the stapes, a bone of the middle ear 103, transmits vibrations via the fenestra ovalis (oval window), to the perilymph of the cochlea 104. As a result, the hair cells of the organ of Corti are excited to initiate chemi-electric pulses that are transmitted to the cochlear nerve 113, and ultimately to the brain.

Some patients may have partially or completely impaired hearing for reasons including: long term exposure to environmental noise, congenital defects, damage due to disease or illness, use of certain medications such as aminoglycosides, or physical trauma. Hearing impairment may be of the conductive, sensineural, or combination types.

Implants often include various electro-magnetic transducers that may function as an actuator, a sensor, and/or a switch. An example of an implant with an electro-magnetic actuator is a middle ear implant which mechanically drives the ossicular chain. Such a middle ear implant that includes a floating mass transducer was developed by Geoffrey Ball et al. (see U.S. Pat. Nos. 5,913,815; 5,897,486; 5,624,376; 5,554,096; 5,456,654; 5,800,336; 5,857,958; and 6,475,134, each of which is incorporated herein by reference).

Magnetic Resonance Imaging (MRI) examination may be contraindicated for a wearer of such an auditory (cochlear or middle ear) prosthesis since potential interactions between the implanted electro-magnetic transducer and the applied external MRI magnetic field may, at higher field strength (i.e. above about 1 Tesla), produce three potentially harmful effects:

1. The implanted magnet experiences a torque ($T=m\times B$) that may twist the electro-magnetic transducer out of its position, thereby injuring the implant wearer and/or destroying the mechanical fixation.
2. Due to the external magnetic field, the implanted magnet becomes partly demagnetized and this may lead to damage or at least to a reduced power efficiency of the electro-magnetic transducer after exposure to the MRI field.
3. Radio frequency (RF) pulses (magnetic field $B_1$ in MRI) emitted by the MRI unit can induce voltages in the coil(s) of the electro-magnetic transducer and this may destroy the transducer and/or may harm the patient.

Because of these risks it may be generally forbidden to undergo (at least high-field) MRI examination for patients with an implant with electro-magnetic transducer. This may exclude the patient from certain important diagnosis methods.

SUMMARY OF THE INVENTION

In a first aspect of the invention, a system for hearing enhancement includes an audio processor that generates an electrical audio signal and transmits the signal to a coil. The coil is implanted into a patient in a position that results in transmission of mechanical stimulation to the inner ear when the coil is spatially displaced. A permanent magnet is placed in proximity to the coil so that when the coil receives the electrical audio signal form the processor, the induced coil magnetic field in the coil interacts with the magnetic field from the permanent magnet to spatially displace the coil and, as a result, transmit the mechanical stimulation to the inner ear.

The permanent magnet may include an outer layer of biocompatible material such as titanium, niobium, tantalum, or stainless steel. Also, a microphone may be included with the system to convert an input acoustic signal into a representative signal output to the processor.

Another aspect of the invention is a method for improving the hearing of a patient that includes implanting a coil into the ear of the patient, and securely attaching a permanent magnet to a bone of the patient in a location that is proximal to the coil, so that the magnetic fields of the magnet and the coil interact under the control of the electrical audio signal to displace the coil and, as a result, transmit mechanical stimulation to the inner ear.

The coil may be directly or indirectly, mechanically coupled to the Malleus, the Incus, the Stapes, the oval window, the round window or a bone proximal to the ear. The mechanical stimulation may therefore travel through the middle ear before arriving at the inner ear. A recess in a bone may be created for the placement and affixation of the permanent magnet. In order to allow for MRI examination of the patient, the permanent magnet may be placed in an orientation that is parallel to the body axis of the patient. A microphone may be affixed to the patient to convert an input acoustic signal into a representative signal output to the processor.

DETAILED DESCRIPTION OF SPECIFIC EMBODIMENTS

Figure 1:
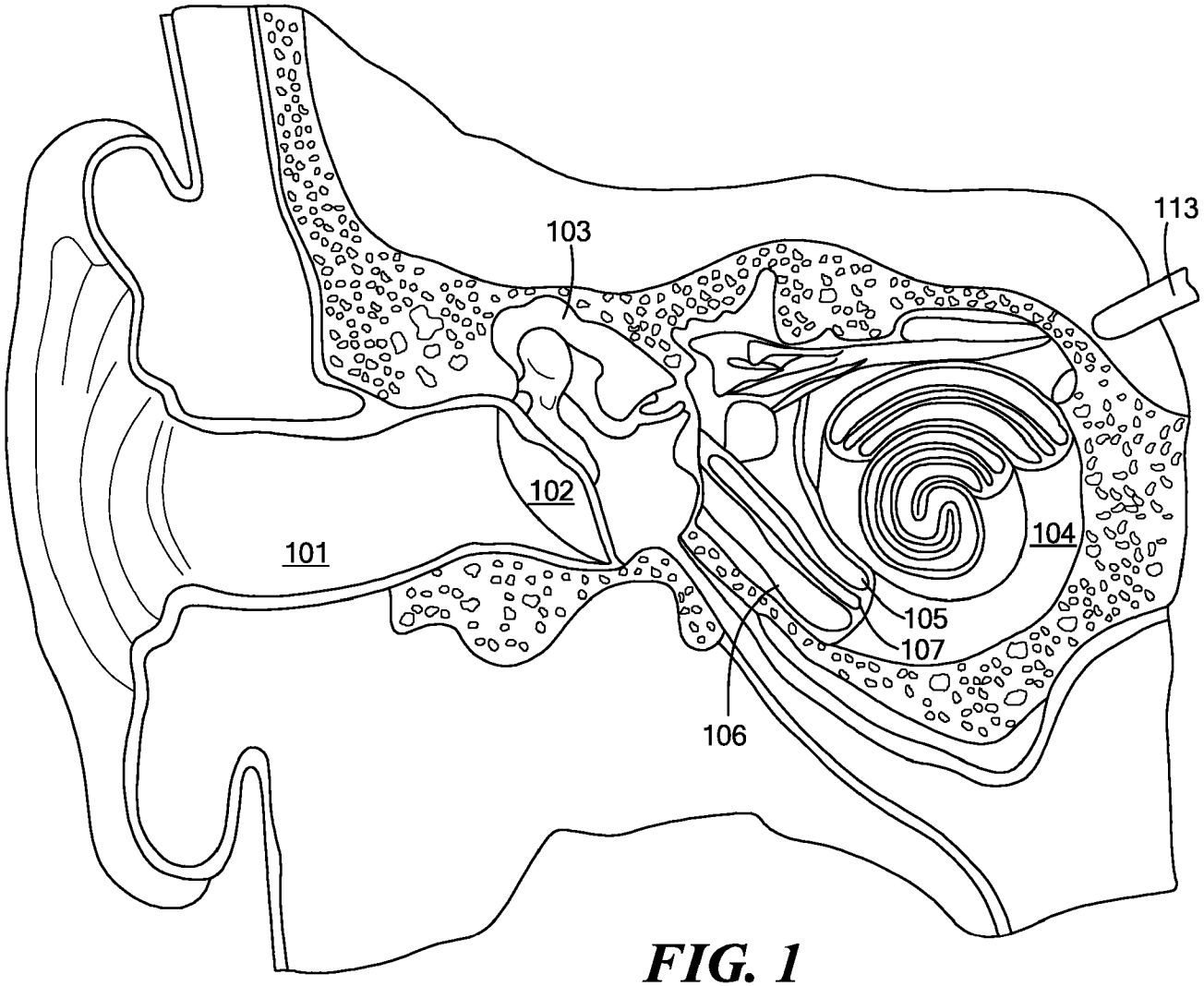
FIG. 1 shows the structure of a normal human ear.
Figure 2:
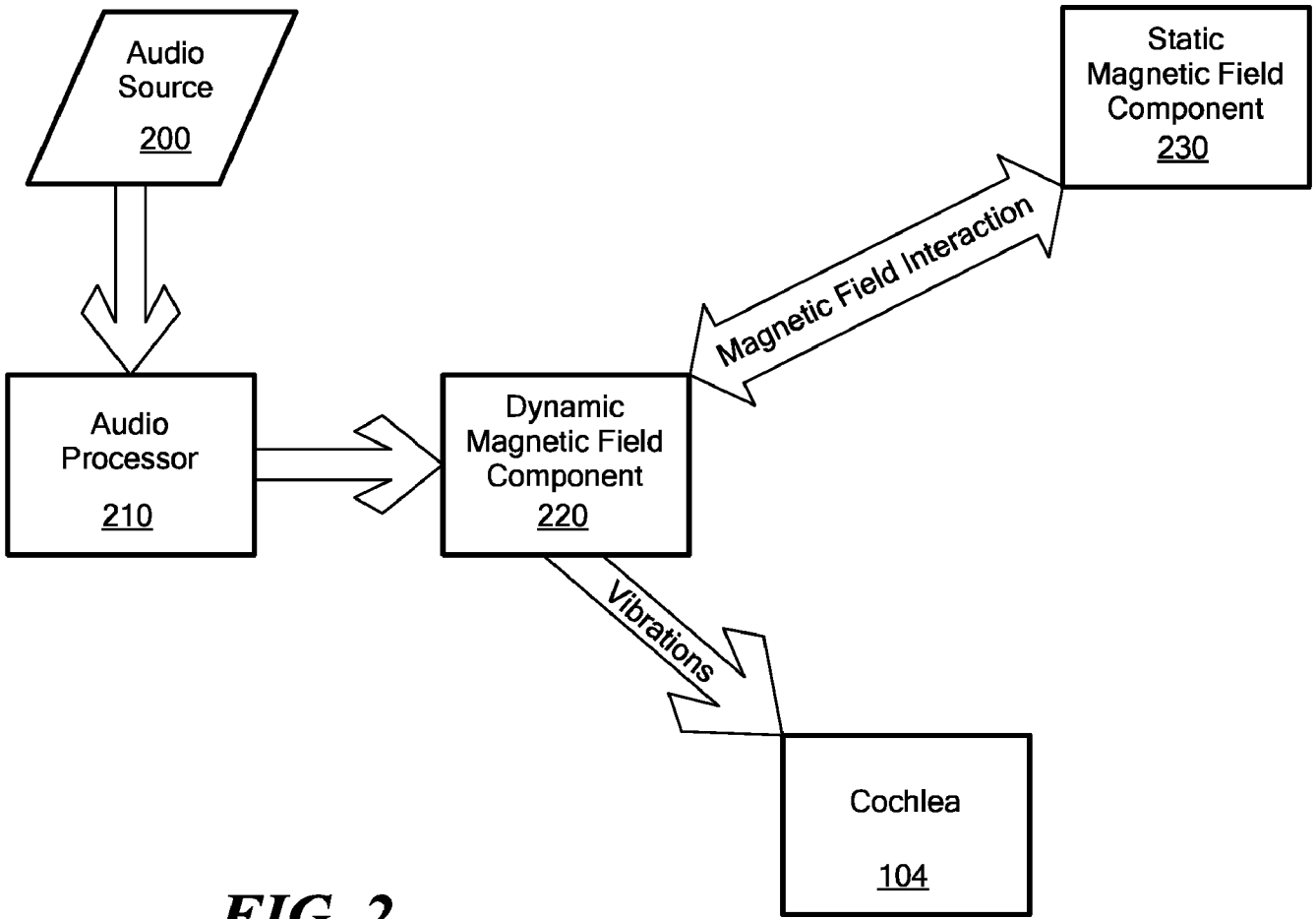
FIG. 2 shows a block diagram of the various components of a hearing enhancement system in accordance with an embodiment of the invention.

Illustrative embodiments of the present invention relate to an implant system for enhancing the hearing of a patient A general functional layout of an implant system is shown in the block diagram of FIG. 2. A static magnetic field component 230 and a dynamic magnetic field component 220 are positioned in magnetic proximity to each other. Additionally, one of the components (the dynamic component as shown here) is mechanically coupled to an anatomical structure that is in mechanical signal communication with the cochlea. For example, the dynamic component may be attached to an anatomical structure of the middle ear or to a membrane of the middle ear or inner ear. An audio processor 210 receives an audio signal from an audio source 200 and produces an electrical audio signal that actuates the dynamic magnetic field component 220 to produce a changing magnetic field. The dynamic magnetic field produced by the dynamic magnetic field component 220 interacts with the static magnetic field produced by the static magnetic field component 230 to spatially displace the dynamic magnetic field component 220; the resulting vibrations are mechanically transmitted to the cochlea 104 to effect hearing perception of the audio source.

Figure 3:
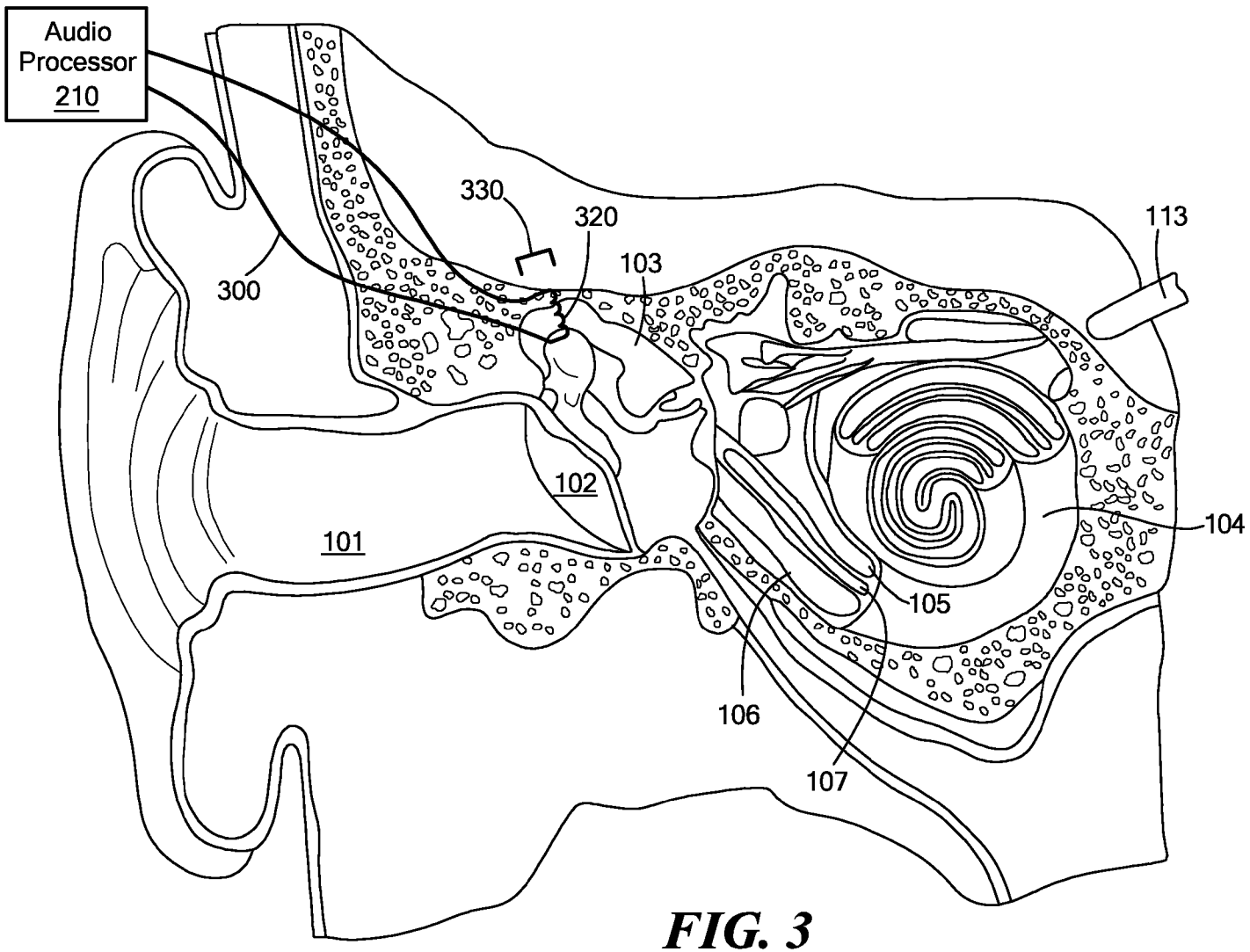
FIG. 3 shows a human ear with implanted components of the system of FIG. 2.

In a more specific embodiment, an inductance coil 320 is used as the dynamic magnetic field component 220 and a permanent magnet 330 is used as the static magnetic field component 230. FIG. 3, shows an example of how these may be implanted in a patient.

The inductance coil 320 and the permanent magnet 330 are positioned by a surgeon so that they are in magnetic proximity. The coil 320 may be attached (e.g., cemented) to an anatomical structure that is either directly or indirectly mechanically coupled to the cochlea. Such structures include the Malleus, the Incus, the Stapes, the oval window, the round window, or a bone proximal to the ear.

The permanent magnet 330 may be, for example, a neodymium or samarium-cobalt magnet, and may be rigidly attached to a bone in proximity to the coil (e.g., attached to a region of the skull). One method for implanting the magnet is to remove a region of bone and to affix the magnet within the recess. The magnet 330 may have an outer layer or coating of a biocompatible material such as titanium, niobium, tantalum, or stainless steel to prevent corrosion. Alternatively, the magnet may be encapsulated within a case, e.g., of titanium, niobium, tantalum, or stainless steel. Alternatively, if the magnet 330 is of sufficient strength, it could be attached to the outside of a patient's skull rather than implanted internally.

The coil 320 may be attached to and driven by the audio processor 210. The audio processor 210 accepts an audio input and provides an appropriately conditioned representative electronic output to the coil 320 to induce a dynamic magnetic field. The induced dynamic magnetic field interacts with the static field produced by the permanent magnet 330, causing movement of the coil 320. As a result, vibrations are transmitted directly to the anatomical structure to which the coil 320 is attached and arrive at the cochlea 104, where the vibrations are transduced into the neural hearing impulses. As a result, the patient should hear sounds representative of the audio input. The coil 320 may be constructed in a way that minimizes vibrations within the coil 320; for example, it may have a rigid but magnetically permeable core.

The audio processor 210 contains electronic components for accepting an audio input from an audio source. In various embodiments, the processor 210 will accept analog signals, digital signals, or both. The audio input may be an analog or digital output from a microphone, telephone, television, stereo system, mp3 player, radio receiver, computer, Voice Over Internet Protocol (VOIP) network, or other device. The audio input may be accepted via wired or wireless connection. The processor 210 may be equipped to accept various types of digital audio information, including Audio Interchange File Format (AIFF), WaveForm (WAV), Windows Media Audio (WMA), True Audio Lossless Codec (TTA), Free Lossless Audio Codec (FLAC), Advanced Audio Encoding (AAC), Ogg Vorbis, Apple Lossless Audio Codec (ALAC) or Shorten (SHN).

Upon accepting the audio signal, the processor 210 may then use various digital or analog amplifiers, filters, converters, digital memory and microprocessors, or other circuitry to condition the audio signal and, if necessary, convert it into an analog electric signal suitable for driving the coil 230 in the presence of the static magnetic field 230. The signal conditioning may include amplification or dampening of particular sounds of various amplitudes and frequencies to enhance the listening experience. The conditioned signal is output from the processor 210 via lead wires 300 to one or both ears of a patient. The processor 210 may be entirely external, or may be implanted into the patient. If implanted, the processor 210 may provide the static magnetic field 230 (e.g. by incorporation of a permanent magnet 330). Of course, the processor 210 may include a power supply, such as a disposable or rechargeable battery, including a Lithium-polymer or zinc-air battery.

In embodiments of the invention the hearing enhancement system is implanted into a patient in a manner that is conducive to permitting the patient to undergo magnetic resonance imaging. If the processor 210 is switched to an inactive state prior to the imaging procedure, the coil 320 will not be displaced in the MRI magnetic field. The magnetic field of a high-field MRI scanner is typically oriented in the direction of the body axis. Choosing an orientation for the permanent magnet 330 that is parallel to the body axis will therefore reduce or eliminate torque on the permanent magnet 330, and may also reduce or eliminate demagnetization of the magnet. Reduction in the potential for demagnetization may also be achieved by appropriate choice of the shape-factor of magnet 330, e.g., a magnet of long cylindrical or prismatic shape provides increased resistance to demagnetization by an opposing external field. In the event that the magnet 330 does become demagnetized by the MRI field, the magnet may be surgically replaced after an MRI procedure. Accordingly, the placement of the magnet 330 may be chosen to allow for facile surgical access for removal and replacement.

In alternative embodiments, the disclosed methods for enhancing hearing may be implemented as a computer program product for use with a computer system. Such implementations may include a series of computer instructions fixed either on a tangible medium, such as a computer readable medium (e.g., a diskette, CD-ROM, ROM, or fixed disk) or transmittable to a computer system, via a modem or other interface device, such as a communications adapter connected to a network over a medium. The medium may be either a tangible medium (e.g., optical or analog communications lines) or a medium implemented with wireless techniques (e.g., microwave, infrared or other transmission techniques). The series of computer instructions embodies all or part of the functionality previously described herein with respect to the system. Those skilled in the art should appreciate that such computer instructions can be written in a number of programming languages for use with many computer architectures or operating systems.

Furthermore, such instructions may be stored in any memory device, such as semiconductor, magnetic, optical or other memory devices, and may be transmitted using any communications technology, such as optical, infrared, microwave, or other transmission technologies. It is expected that such a computer program product may be distributed as a removable medium with accompanying printed or electronic documentation (e.g., shrink wrapped software), preloaded with a computer system (e.g., on system ROM or fixed disk), or distributed from a server or electronic bulletin board over the network (e.g., the Internet or World Wide Web). Of course, some embodiments of the invention may be implemented as a combination of both software (e.g., a computer program product) and hardware. Still other embodiments of the invention are implemented as entirely hardware, or entirely software (e.g., a computer program product).

The described embodiments of the invention are intended to be merely exemplary and numerous variations and modifications will be apparent to those skilled in the art. All such variations and modifications are intended to be within the scope of the present invention as defined in the appended claims.

What is claimed is:

1. A hearing enhancement system comprising: an audio processor for generating an audio electrical signal; a permanent magnet having an associated permanent magnet field, the permanent magnet for affixing to a recess in a bone of a skull proximal to an ear of a patient; and an implantable stimulation coil mechanically coupleable to an inner of the patient for receiving the audio electrical signal, and in response generating a coil magnetic field that interacts with the permanent magnetic field so as to displace the stimulation coil and mechanically stimulate the inner with an audio mechanical signal corresponding to the audio electrical signal.

2. A system according to claim 1, wherein the permanent magnet includes and outer layer of biocompatible material.

3. A system according to claim 2, wherein the biocompatible material is selected from the group consisting of: titanium niobium, tantalum, and stainless steel.

4. A system according to claim 1, wherein the permanent magnet includes an outer layer of material to prevent corrosion of the magnet.

5. A system according to claim 1, further including a microphone for converting an input acoustic signal into a representative microphone electrical signal output to the audio processor.

* * * * *

UNITED STATES PATENT AND TRADEMARK OFFICE

CERTIFICATE OF CORRECTION

PATENT NO. : 7,744,525 B2
APPLICATION NO. : 11/782123
DATED : June 29, 2010
INVENTOR(S) : Ingeborg Hochmair et al.

It is certified that error appears in the above-identified patent and that said Letters Patent is hereby corrected as shown below:

In the claims:

In Col. 5, line 10, claim 1
replace "inner of"
with "inner ear of."

In Col. 6, line 2, claim 2
replace "and outer layer"
with "an outer layer."

Signed and Sealed this

Fifth Day of October, 2010

David J. Kappos

David J. Kappos
*Director of the United States Patent and Trademark Office*